US006815061B2

(12) United States Patent
Van Heerden et al.

(10) Patent No.: US 6,815,061 B2
(45) Date of Patent: Nov. 9, 2004

(54) CONDUCTIVE FIBER

(75) Inventors: Clive R. Van Heerden, Bronx, NY (US); George Marmaropoulos, Yorktown Heights, NY (US)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 10/696,520

(22) Filed: Oct. 29, 2003

(65) Prior Publication Data

US 2004/0087228 A1 May 6, 2004

Related U.S. Application Data

(62) Division of application No. 10/084,711, filed on Feb. 25, 2002, now Pat. No. 6,686,038.

(51) Int. Cl.[7] ..... D01F 8/00; H01B 7/00

(52) U.S. Cl. ..... 428/370; 428/373; 428/377; 428/379; 174/110 R; 174/120 R

(58) Field of Search ..... 428/370, 373, 428/377, 375, 379; 174/110 R, 120 R

(56) References Cited

U.S. PATENT DOCUMENTS 4,388,370 A * 6/1983 Ellis et al. ..... 428/368
6,534,715 B1 * 3/2003 Maunder et al. ..... 174/110 R
6,686,038 B2 * 2/2004 Van Heerden et al. ..... 428/370

* cited by examiner

*Primary Examiner*—Cynthia H. Kelly
*Assistant Examiner*—Jill M. Gray

(57) ABSTRACT

There is provided a conductive fiber capable of being sewn, woven or knitted, using conventional methods, into a conductive mesh for use with various wearable electronic devices and/or sensors that make direct contact with the skin. The conductive fiber, when combined with a non-slip fiber, facilitates comfortable electrical communication between different electronic devices and the skin.

10 Claims, 2 Drawing Sheets

CONDUCTIVE FIBER

This is a divisional of U.S. Pat. No. 10/084,711, filed Feb. 25, 2002, now U.S Pat. No. 6,686,038.

FIELD OF THE INVENTION

The present invention relates to a conductive fiber. More particularly, the present invention relates to a flexible, conductive silicon fiber for use with wearable electronic and sensor devices making contact with the skin.

DESCRIPTION OF THE PRIOR ART

The use of conductive fibers in various sewn or woven fabrics used as conductive traces, bio-sensors, electrodes, and other wearable electronic devices is well known. It is also commonly known to incorporate conductive silicon into these different fabrics to prevent the conductive fibers, which typically include at least some metal, from making direct contact with the skin. The use of silicon provides flexibility and helps to eliminate the negative effects associated with metal directly contacting the skin. A drawback of silicon, however, is that it tends to become slippery when exposed to moisture (e.g. perspiration). Thus, there is a need for a conductive fiber having the beneficial properties of conductive silicon without the above noted drawback. The preferred embodiments of the present invention fulfill this need.

SUMMARY OF THE INVENTION

It is an object of the present invention to provide an improved conductive fiber for direct contact with skin.

It is another object of the present invention to provide such a conductive fiber configured for prolonged contact with skin.

It is still another object of the present invention to provide such a conductive fiber capable of being woven, knitted, and/or sewn by conventional methods.

It is yet another object of the present invention to provide such a conductive fiber adapted for use with various wearable electronic devices and/or sensors.

It is a further object of the present invention to provide such a conductive fiber adapted for use with various textile elements including electrical instruments such as medical instruments, electrodes and sensors.

It is still a further object of the present invention to provide such a conductive fiber that enhances comfort and reduces the negative side effects derived from long-term contact with the skin.

These and other objects and advantages of the present invention are achieved by a first preferred embodiment of the conductive fiber of the present invention. The conductive fiber comprising a fiber mesh or construction preferably having one or more non-slip fibers and one or more conductive fibers intertwined with the one or more non-slip fibers. These non-slip and conductive fibers are intertwined using any known conventional method for weaving, sewing or knitting. Preferably, the one or more conductive fibers have a conductive threadlike core enclosed by a conductive semi-fluid sleeve.

The objects and advantages of the present invention may also be achieved by a second preferred embodiment of the conductive fiber of the present invention. This conductive fiber has a conductive threadlike core with an outer layer of at least two different fibers. The at least two different fibers include at least one non-slip fiber and at least one semi-fluid conductive fiber. Preferably, the conductive fiber can be sewn, woven or knitted using conventional methods to form a conductive fiber mesh or construction.

BRIEF DESCRIPTION OF THE DRAWINGS

The present invention is more fully understood by reference to the following detailed description of a preferred embodiment in combination with the drawings identified below.

DETAILED DESCRIPTION OF THE INVENTION

Figure 1:
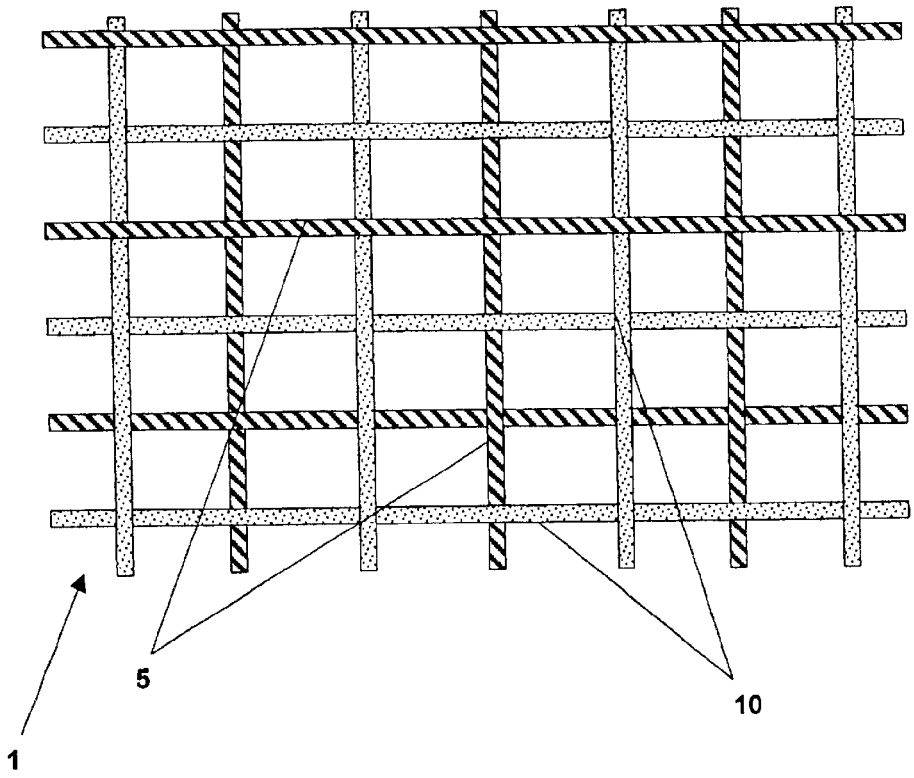
FIG. 1 is a plan view of a fiber mesh or construction in accordance with a first preferred embodiment of the present invention.

Referring to the drawings and, in particular, FIG. 1, there is shown an improved fiber mesh or construction in accordance with a first preferred embodiment of the present invention generally represented by reference numeral 1. Preferably, fiber construction 1 has one or more non-slip fibers 5 and one or more conductive fibers 10. The one or more conductive fibers 5 are intertwined with the one or more non-slip fibers using any known conventional method for weaving, sewing or knitting.

Each non-slip fiber 5 preferably has properties that facilitate comfortable engagement with the skin. For example, a rubber extruded fiber may be used. Non-slip fibers 5 preferably can also have different shapes or sizes such that fiber construction 1 can have different adaptations to accommodate different uses.

Figure 2:
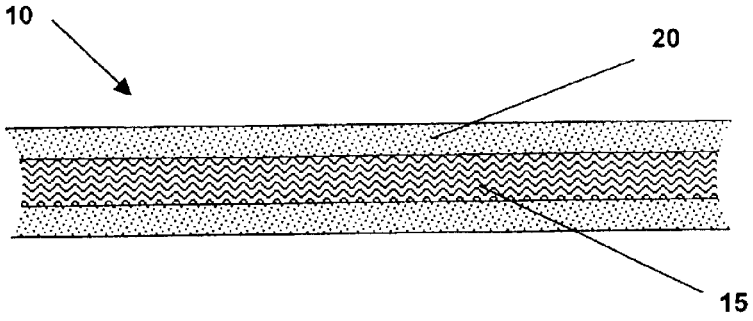
FIG. 2 is a longitudinal section view of a first conductive fiber of the fiber mesh of the preferred embodiment of FIG. 1.

Referring to FIG. 2, each conductive fiber 10 has a conductive threadlike or fiber core 15 enclosed by a conductive semi-fluid sleeve 20. Preferably, core 15 and sleeve 20 are configured to engage securely together. Sleeve 20 is preferably connected to core 15 via sonic welding. However, other connecting methods may also be used.

Preferably, each conductive fiber 10 has a high tensile strength and a weight and consistency of a material that provides a high degree of flexibility during manufacture and wear. Each conductive fiber 10 preferably also facilitates electrical communication between an electrical power source (not shown) and fiber construction 1. A connector (not shown) preferably provides a medium for the electrical communication between the electrical power source and fiber construction 1. The connector can have any configuration suitable to provide the means or way for this electrical communication. Conductive fibers 10, similar to non-slip fibers 5, can preferably also have different shapes or sizes such that fiber construction 1 can have different adaptations to accommodate different uses.

Core 15 can preferably have different conductivities. Core 15 can be made of any suitable conductive material, including for example, a metalized foil, a conductive polymer, or a graphitized or metalized fiber or yarn.

Sleeve 20 is preferably made of an electrically conductive silicon gel. However, any material having a similar conductivity and viscosity to that of silicon gel may also be used. The viscosity of sleeve 20 preferably facilitates adhesion to core 15. Sleeve 20 facilitates electrical communication between conductive fiber 10 and the skin. This electrical communication preferably facilitates performing various operations. For example, such operations include providing selective electronic massage therapy, selectively collecting and recording electronic data, and/or providing selective electrical stimulation.

Thus, fiber construction 1 forms a conductive fabric preferably configured for use with various wearable electronic devices and/or sensors that make direct contact with the skin. Preferably, conductive fibers 10 can be woven into a multitude of different patterns facilitate different applications in use.

Figure 3:
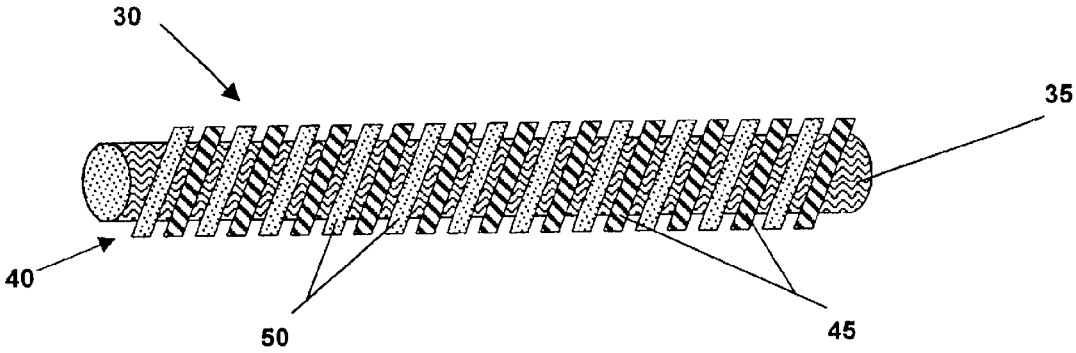
FIG. 3 is a plan view of a second conductive fiber in accordance with a second preferred embodiment of the present invention.

Referring to FIG. 3, there is shown a conductive fiber in accordance with a second preferred embodiment of the present invention generally represented by reference numeral 30. Preferably, conductive fiber 30 has a conductive threadlike or fiber core 35 with an outer layer 40. Outer layer 40 has at least one non-slip fiber 45 and at least one semi-fluid conductive fiber 50 securely wrapped about fiber core 35. Preferably, conductive fiber 30 can be sewn, woven, or knitted using conventional methods into a conductive non-slip fiber mesh or fabric. Preferably, conductive fiber 30 is suitable to be woven into a multitude of different patterns in order to facilitate different applications in use.

Fiber core 35 can preferably have different conductivities. Fiber core 35 can be made of any suitable conductive material, including for example, a metalized foil, a conductive polymer, or a graphitized or metalized fiber or yarn. Fiber core 35 preferably facilitates electrical communication between an electrical power source (not shown) and semi-fluid conductive fiber 50.

Non-slip fiber 45 of outer layer 40 has properties that facilitate comfortable engagement with the skin. For example, a rubber extruded fiber may be used. Non-slip fiber 45 can also have different shapes or sizes such that conductive fiber 30 can have different adaptations to accommodate different uses.

Semi-fluid conductive fiber 50 of outer layer 40 is preferably made of an electrically conductive silicon gel. However, any material having a similar conductivity and viscosity to that of silicon gel may also be used. The viscosity of semi-fluid conductive fiber 50 preferably facilitates adhesion to fiber core 35. Also, semi-fluid conductive fiber 50 preferably facilitates comfortable electrical communication between conductive fiber 30 and the skin.

Thus, conductive fiber 30 can be used to create a conductive non-slip fabric that can preferably be used in conjunction with a variety of electrical mechanisms. For example, such mechanisms include wearable devices or sensors, medical instruments, and different health and fitness therapy devices. This conductive non-slip fabric, similar to fiber construction 1, can preferably be any desired shape, size or configuration necessary to perform a desired function.

The present invention having been thus described with particular reference to the preferred forms thereof, it will be obvious that various changes and modifications may be made therein without departing from the spirit and scope of the present invention as defined herein.

What is claimed is:

1. A conductive fiber comprising:

a conductive fiber core;

a non-slip fiber being wrapped around said conductive fiber core; and a conductive semi-fluid fiber being wrapped around said conductive fiber core in coincidence with said non-slip fiber.

2. A conductive fiber of claim 1, wherein said conductive fiber is adapted to engage said non-slip fiber and said conductive semi-fluid fiber.

3. The conductive fiber of claim 1, wherein said conductive fiber core is made of a conductive polymer.

4. The conductive fiber of claim 1, wherein said conductive fiber core is a conductive metalized fiber.

5. The conductive fiber of claim 1, wherein said conductive fiber core is a conductive graphitized fiber.

6. The conductive fiber of claim 1, wherein said conductive fiber core is made of a conductive metalized foil.

7. The conductive fiber of claim 1, wherein said conductive semi-fluid fiber has a viscosity to facilitate adhesion to said conductive fiber core.

8. The conductive fiber of claim 1, wherein said conductive semi-fluid fiber is connected to said conductive fiber core.

9. The conductive fiber of claim 1, wherein said non-slip fiber is connected to said conductive fiber core.

10. The conductive fiber of claim 1, wherein said conductive semi-fluid fiber and said non-slip fiber are sonically welded to said conductive fiber core.

* * * * *